United States Patent [19]

McCollom

[11] Patent Number: 5,027,678

[45] Date of Patent: Jul. 2, 1991

[54] CAM ACTUATOR MEANS WITH CONNECTOR ASSEMBLY

[76] Inventor: Robert M. McCollom, 3103 N. Elizabeth, Pueblo, Colo. 81008

[21] Appl. No.: 600,327

[22] Filed: Oct. 19, 1990

[51] Int. Cl.[5] ..... B25B 13/50

[52] U.S. Cl. ..... 81/53.2; 81/3.44; 411/238; 411/433; 188/77 R

[58] Field of Search ..... 81/53.2, 3.44, 120; 279/6, 71; 411/433, 432, 267, 238; 188/77 R, 82.6

[56] References Cited

U.S. PATENT DOCUMENTS

| | | | |
|---|---|---|---|
| 1,279,349 | 9/1918 | Johnson | 81/53.2 |
| 2,167,171 | 7/1939 | Dodge | 188/77 R |
| 2,509,647 | 5/1950 | Lipscomb | 411/238 |
| 2,560,012 | 7/1951 | Valvano | 81/53.2 |
| 2,681,582 | 6/1954 | Valvano | 81/53.2 |
| 2,746,328 | 5/1956 | Valvano | 81/53.2 |
| 2,815,788 | 12/1957 | Tarwater | 411/238 |
| 4,378,187 | 3/1983 | Fullerton | 411/267 |

*Primary Examiner*—Roscoe V. Parker

[57] ABSTRACT

This invention is a cam actuator means with connector assembly with one embodiment being a stud extractor and wrench apparatus operable to utilize a cam insert member mounted within an outer housing member being engagable with a damaged bolt head on a stud member using a cam actuator clamping action to grasp same for inserting and removing. A second embodiment is a main brake lock apparatus having a brake insert member mounted within an outer brake housing member being engagable with a rotating shaft to achieve a braking or clutching action therewith through a cam actuator clamping action. The brake actuator assembly uses a piston and cylinder actuator assembly selectively operable through fluid control means to contact and engage the shaft for the braking or clutching action. A third embodiment is a bolt and elliptical lock nut apparatus having an inner lock cam insert member mounted within a main lock nut assembly. The inner lock cam insert member is engageable with a threaded bolt member at any longitudinal position being operable through relative rotational movement between the main lock nut assembly and the inner lock cam insert member to a achieve a cam actuator clamping action on a threaded body section of the bolt member. The nut and elliptical lock nut apparatus is operable to achieve a firm and economical clasping on a bolt member to achieve a lock nut feature of this invention.

19 Claims, 2 Drawing Sheets

CAM ACTUATOR MEANS WITH CONNECTOR ASSEMBLY

PRIOR ART

The inventor herein has filed a United States patent application Ser. No. 357,990; filed May 30, 1989; entitled "STUD EXTRACTOR AND WRENCH APPARATUS and now U.S. Pat. No. 4,970,917.

A prior patent search on the aforementioned patent application revealed the following United States patents:

| U.S. Pat. No. | Invention | Inventor |
|---|---|---|
| 232,923 | WRENCH | Alfred Beard |
| 1,279,349 | WRENCH | Todd J. Johnson |
| 2,254,681 | SOCKET WRENCH | Fred B. Honchock |
| 2,555,836 | SOCKET WRENCH | Herbert A. Werich |
| 2,560,012 | UNIVERSAL STUD PULLER AND DRIVER | Ralph A. Valvano |
| 2,681,582 | STUD DRIVING AND REMOVING WRENCH | Ralph A. Valvano |
| 2,746,328 | STUD PULLER AND DRIVER WRENCH | Ralph A. Valvano |
| 3,735,650 | EXTRACTOR TOOL | Francis H. Weng, Jr. |
| 3,889,557 | STUD REMOVING TOOL | Richard H. Young |
| 4,724,730 | WRENCH SOCKET WITH CAM LOCKING FEATURE | Mader et al |

ANALYSIS

The Beard patent discloses a pipe wrench strcture having a serrated key structure in order to grasp and rotate a pipe member but is substantially different in appearance and operation.

The Johnson patent discloses a wrench structure which utilizes a pair of wedges in order to move a movable jaw relative to a fixed jaw.

The Honchock patent discloses a socket wrench utilizing a cam action in order to grasp a nut member for removal thereof.

The Werich patent discloses a socket wrench using a cam action to grasp a nut member.

The Valvano U.S. Pat. No. 2,560,012 discloses a stud puller structure which utilizes a cam action in order to grasp the threads or a smooth shank portion of a stud member.

The Valvano U.S. Pat. No. 2,681,582 was not found in applicant's patent search but was cited a primary reference used in the initial rejection of applicant's now allowed U.S. patent application Ser. No. 357,990, filed May 30, 1989.

The Valvano U.S. Pat. No. 2,746,328 discloses a stud puller having an oval shaped opening with a jaw member mounted therein. The jaw member is moved inwardly by adjustment screws and a threaded pin in order to clamp about a stud bolt.

The Weng Jr. patent discloses an extractor tool utilizing a cam action in order to grasp the head of a bolt or screw member.

The Young patent discloses a stud removing tool utilizing a plurality of roller members which are cam actuated in order to grasp a hexagonal head of a bolt member.

The Mader et al patent discloses a plurality of cam members which are moved into a locking, grasping relationship on rotation in either direction.

PREFERRED EMBODIMENT OF THE INVENTION

In one preferred embodiment of this invention, a cam actuator means with connector assembly is operable in various embodiments to 1) operate as an extractor for rotating and removing an object such as a bolt member; 2) control shaft rotation in a braking or clutching operation; and 3) locking onto an object such as a threaded bolt in a lock nut function. The cam actuator means with connector assembly includes three embodiments being 1) a stud extractor and wrench apparatus; 2) a main brake lock apparatus; and 3) a bolt and elliptical lock nut apparatus. The stud extractor and wrench apparatus is provided with a main cam lock assembly rotatable through a main drive assembly. The main cam lock assembly includes an outer housing member with a cam insert member mounted therein. The cam insert member is of an elliptical shape and operable on rotation of the outer housing assembly to provide a clamping action on a bolt head or stud member. The main drive assembly is provided with a ratchet drive assembly connected to a ratchet handle assembly operable to selectively rotate the outer housing member of the main cam lock assembly. The main brake lock apparatus includes a main brake lock assembly movable through connection to a brake actuator assembly. The brake lock assembly includes an outer brake housing member having a brake cam insert member mounted therein. The brake insert member includes an elliptical brake cam body with an elliptical opening mounted about a rotatable drive shaft for a clutching or braking operation. The brake actuator assembly includes a connector assembly connected to a piston and cylinder actuator assembly which, in turn, is operably connected to the outer brake housing member to selectively control rotation thereof relative to the brake cam insert member. The bolt and elliptical lock nut apparatus or main lock assembly includes a main lock nut assembly having an inner lock cam insert member connected thereto. The main lock nut assembly includes an outer nut housing member having an elliptical cavity hole or opening in which the inner lock cam insert member is mounted. The inner lock cam insert member is provided with an elliptical nut cam body having a central threaded bolt opening operable to have a bolt member threadably mounted therein. The nut cam body is provided with an outer cam surface having adjacent lock serrated ridges thereon. The outer nut housing member is provided with an elliptical cavity hole or opening with serrated lock ridges and a nut stabilizer member. The central threaded bolt opening is operable to receive a bolt member therein and, on rotation relative to the inner lock cam insert member, the serrated lock ridges and the lock serrated ridges are engagable similar to a one-way ratchet assembly so as to provide a clamping action on the bolt member and achieve a lock nut feature of this invention.

OBJECTS OF THE INVENTION

One object of this invention is to provide a cam actuator means with connector assembly operator to achieve unique functions of this invention such as 1) grasping and rotating a stud member or bolt head which has been damaged for removing same; 2) braking or clutching onto a rotating shaft through an actuator assembly; and 3) locking onto an object such as a threaded shaft through a lock nut function.

Another object of this invention is to provide a stud extractor and wrench apparatus having a main cam lock assembly engagable through a cam insert member with a stud or bolt member and operable through a main drive assembly to grasp same and remove the subject stud or bolt member.

One other object of this invention is to provide a main brake lock apparatus which can be selectively connected to a rotating drive shaft in a braking or clutching operation through use of a main brake lock assembly mounted about the rotating drive shaft.

One further object of this invention is to provide a bolt and elliptical lock nut apparatus including a main lock nut assembly having a lock cam insert member operable to be mounted about a threaded portion of a threaded bolt member to achieve a lock nut function therewith.

Still, one other object of this invention is to provide a cam actuator means with connector assembly which is easy to operate; economical to manufacture; and substantially maintenance free.

Various other objects, advantages, and features of the invention will become apparent to those skilled in the art from the following discussion, taken in conjunction with the accompanying drawings, in which:

FIGURES OF THE INVENTION

Figure 1:
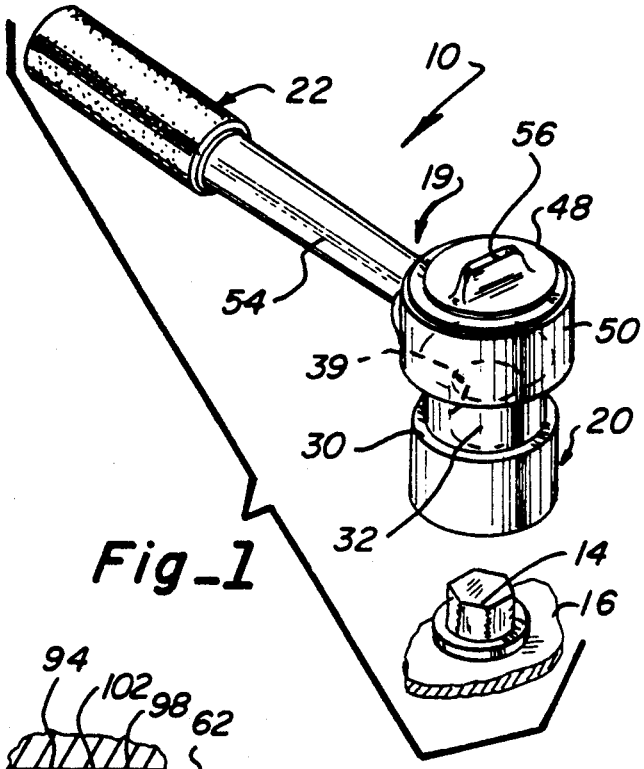
FIG. 1 is a perspective view of a stud extractor and wrench apparatus embodiment of this invention illustrated as positioned above a stud or bolt member to removed from an engine block.

The following is a discussion and description of preferred specific embodiments of the cam actuator means with connector assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail, and in particular to FIG. 1, a cam actuator means with connector assembly of this invention, indicated generally at 10, is operable for rotating, braking, and locking onto an object.

The cam actuator means with connector assembly 10 includes structure for attaching onto a stripped stud or bolt member 14 mounted within an engine block 16 or onto a bolt head 18 for removing same.

The cam actuator means with connector assembly 10 consists of three embodiments being 1) a stud extractor and wrench appartus 19; 2) a main brake lock apparatus 21; and 3) a bolt and elliptical lock nut apparatus 23 for locking on a threaded portion of a bolt member at any desired longitudinal location in a ratchet cam type operation as will be explained.

The stud extractor and wrench apparatus 19 sets forth an improvement over the applicant's U.S. patent application Ser. No. 357,990; filed May 30, 1989; entitled "STUD EXTRACTOR AND WRENCH APPARATUS" and subject patent application has a full, detailed description of the operation of this embodiment set forth in FIGS. 1 and 2 of this application.

The stud extractor and wrench apparatus 19 includes a main cam lock assembly 20 interconnected to a main drive assembly 22. The main cam lock assembly 20 includes an outer housing member 24 having a cam insert member 26 mounted therein.

The outer housing member 24 is provided with 1) an elliptical cavity opening 28; 2) a peripheral lip section 30; and 3) a wrench head section 32.

The elliptical cavity opening 28 is provided with an inner cam surface 34 and an insert stabilizer 36 which is the specific improvement of this embodiment over the applicant's previously above noted filed patent application entitled "STUD EXTRACTOR AND WRENCH APPARTUS". The insert stabilizer 36 is provided with an outer cam surface 38 for reasons to be explained.

The wrench head section 32 is provided with a ratchet connector opening 39 to be connected to the main drive assembly 22.

The cam insert member 26 is provided with 1) an elliptical cam body 40 having a central serrated opening 42; 2) a pair of spaced tool connector openings 44; 3) an outer cam surface 46; and 4) a split ring slot 47.

The central serrated opening 42 is provided with teeth or ratchet sections 49 which are engagable with the stud member 14 or the bolt head 18 in a manner to be explained.

The cam insert member 26 is provided with adjacent opposite cam contact surfaces 51 at the area of the split ring slot 47 operable to initially engage the cam surface 38 of the insert stabilizer 36 in a manner to be explained.

The main drive assembly 22 is provided with a ratchet drive assembly 48 connected to a ratchet handle member 54. The ratchet drive assembly 48 is provided with a ratchet head assembly 50 interconnected to an actuator member 56. The main drive assembly 22 is operable similar to any socket and ratchet drive assembly operable to grasp and be connected through the ratchet connector opening 39 to rotate the outer housing member 34 in either direction as noted by an arrow in FIG. 2.

Figure 3:
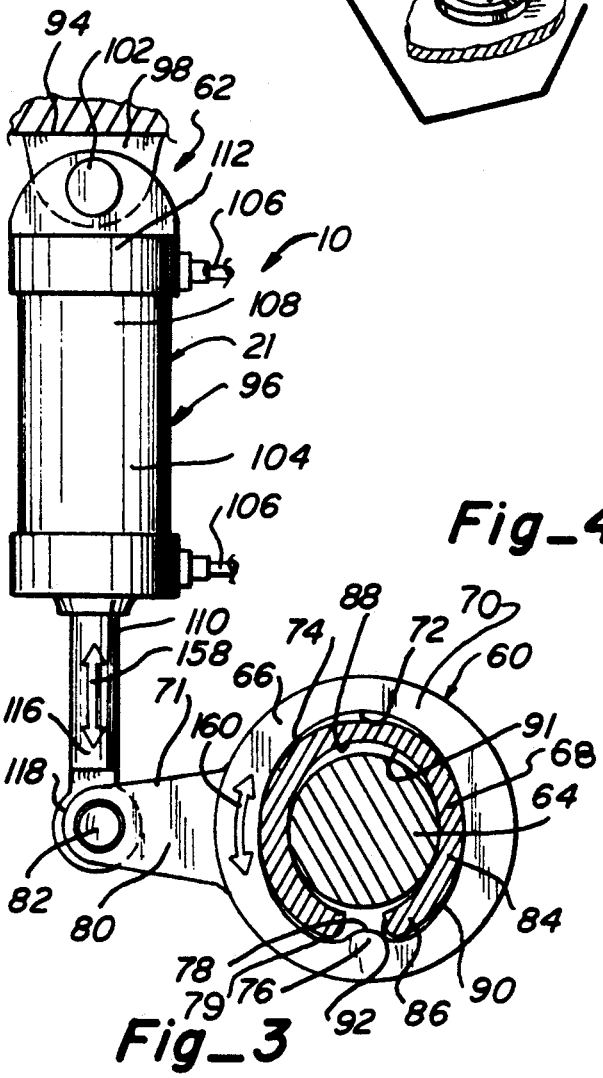
FIG. 3 is an elevational view of a main brake lock apparatus embodiment of this invention.

The main brake lock apparatus 21, as noted in FIG. 3, includes a main brake lock assembly 60 interconnected to a brake actuator assembly 62 in order to grasp onto a rotating shaft 64 to achieve a braking or clutching function therewith.

The main brake lock assembly 60 includes 1) an outer brake housing assembly 66; and 2) a brake insert member 68 mounted within the outer brake housing assembly 66 and operable to selectively engage the shaft 64 as will be noted.

The outer brake housing assembly 66 includes a main housing 70 having a connector assembly 71 connected thereto. The main housing 70 includes an elliptical brake cavity opening 72 having an inner brake cam surface 74 and a brake insert stabilizer 76. The brake insert stabilizer 76 is provided with an outer cam surface 78 to be engagable with cam contact surfaces 79 of the brake insert member 68 as will be noted.

The connector assembly 71 includes a connector lug 80 which is pivotally connected to a pivot shaft 82 which, in turn, is connected to the brake actuator assembly 62 in a manner to be explained.

The brake insert member 68 includes an elliptical brake cam body 86 having a central elliptical opening 88 therein. The elliptical brake cam body 86 is provided with an outer cam surface 90 and an inner cam surface 91. The outer cam surface 90 is provided with a split cam ring slot 92. The inner cam surface 91 may be provided with a brake lining member 93 as specifically noted in FIGS. 9 and 10 to achieve the braking or clutching operation.

As noted in FIG. 3, the brake actuator assembly 62 includes a connector assembly 94 secured to a support surface and having a piston and cylinder actuator assembly 96 connected thereto.

The connector assembly 94 includes an anchor lug member 98 which may be secured to a fixed object and having a support shaft 102 which is pivotally connected the piston and cylinder actuator assembly 96.

The piston and cylinder actuator assembly 96 includes a fluid piston and cylinder member 104 interconnected to fluid control lines 106 from a control means (not shown) for operation thereof.

The piston and cylinder member 104 includes a cylinder member 108 enclosing a piston member 110. The cylinder member 108 includes an anchor portion 112 which is pivotally connected to the support shaft 102 of the connector assembly 94.

The piston member 110 includes a piston head (not shown) interconnected to a piston rod 116 having an outer connector section 118. The connector section 118 is pivotally connected to the pivot shaft 82 of the connector assembly 71 and the main brake lock assembly 60.

Fluid pressure can be selectively supplied through the fluid control lines 106 to either side of the piston member 110 to cause rotational movement of the brake housing member 66 as indicated by an arrow in FIG. 3.

Figure 4:
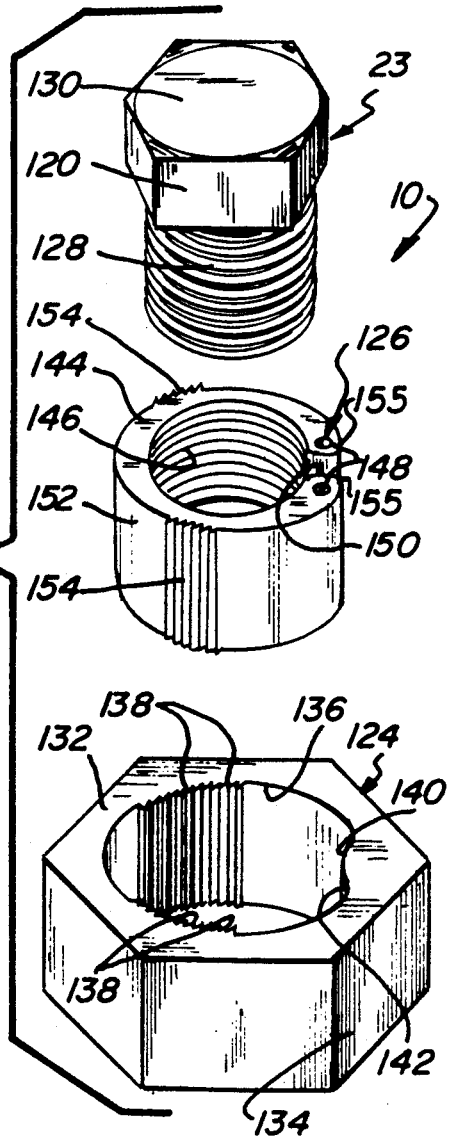
FIG. 4 is an exploded perspective view of a bolt and elliptical lock nut apparatus embodiment of this invention.

As noted in FIG. 4, the bolt and elliptical lock nut apparatus 23 embodiment is operable to be attached to a threaded bolt member 120 through use of a main lock nut assembly 124 having an inner lock cam insert member 126 mounted therein. The threaded bolt member 120 is provided with a threaded body section 128 integral with a hexagonal head section 130.

The main lock nut assembly 124 includes 1) a nut housing member 132 having outer wrench connector walls 134 about which a wrench may be mounted for rotation thereof; 2) an elliptical central cavity hole or opening 136 having serrated lock ridges 138 therein; and 3) a nut stabilizer 140. The serrated lock ridges 138 are preferably twelve (12) in number and are inclined in one direction to achieve a one-way ratchet operation as will be explained.

The nut stabilizer 140 is provided with an outer nut cam surface 142 operable to engage a portion of the inner lock cam insert member 126 in a manner to be explained to facilitate operation thereof.

The inner lock cam insert member 126 includes 1) an elliptical nut cam body 144; 2) a central threaded bolt opening 146 within the elliptical nut cam body 144; 3) a pair of spaced tool connector openings 148 for assembly and interchangable purposes; 4) a split ring slot 150; 5) outer cam surfaces 152; and 6) lock serrated ridges 154 to achieve a one-way ratchet operation in cooperation with the serrated lock ridges 138 of the main lock nut assembly 124 as will be explained.

The lock cam insert member 126 is provided with cam contact surfaces 155 adjacent the split ring slot 150 to initially engage the nut cam surfaces 142 of the nut stabilizer 140.

USE AND OPERATION OF THE INVENTION

Figure 2:
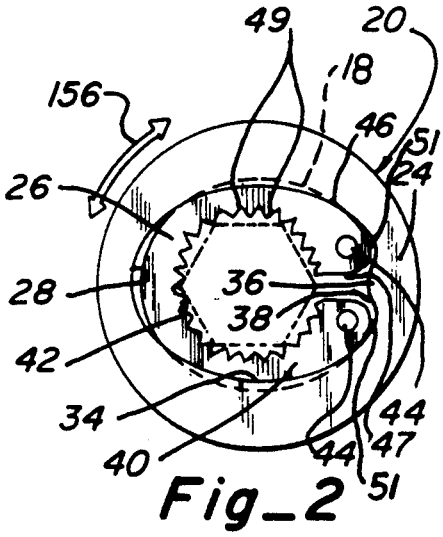
FIG. 2 is a sectional view of the stud extractor and wrench apparatus of this invention illustrated as mounted about a bolt head member to be removed.

In the use and operation of the stud extractor and wrench apparatus 19 embodiment of this invention as noted in FIGS. 1 and 2, it is obvious that the first assembly step is to place the cam insert member 26 within the outer housing member 24. This is achieved by utilizing an insert tool which interconnects to the tool connector openings 44 in order to contact and move same into the assemblied position as noted in FIG. 2. Various sizes of cam insert members 26 having different sizes of central serrated openings 42 can be used with one outer housing member 24.

Then, the cam insert member 26 and, more specifically, the central serrated opening 42, can be mounted about a stud member 14 in an engine block 16 as noted in FIG. 1.

In that condition, it is obvious that the main drive assembly 22 can be connected through the ratchet drive assembly 48 to the outer housing member 24 and, more specifically, through the ratchet connector opening 39.

In this condition, it is obvious that the ratchet handle assembly 54 can be operable through the actuator member 56 to rotate the outer housing member 24 in a clockwise or counter clockwise direction as noted by an arrow 156 in FIG. 2.

In this initial rotational movement, it is noted that the outer cam surface 38 of the insert stabilizer 36 is operable to initially engage the outer cam contact surfaces 51 of the cam surface 46 of the cam insert member 26. This causes an initial inward movement of the cam insert member 26 so as to engage the bolt head 18 as noted in FIG. 2 to prevent internal slippage.

This provides a decrease in the size of the central serrated opening 42 so as to grasp through the teeth or notch sections 49 onto the bolt head 18 for ease of inserting or removing same from the engine block 16.

The improvement in the stud extractor and wrench apparatus embodiment 19 over the applicant's prior United States patent application is the addition of the insert stabilizer 36 which provides a means for contacting and prevents undesirable initial rotation of the cam insert member 26 and achieves a superior and efficient operation over the noted prior patent application.

Figure 9:
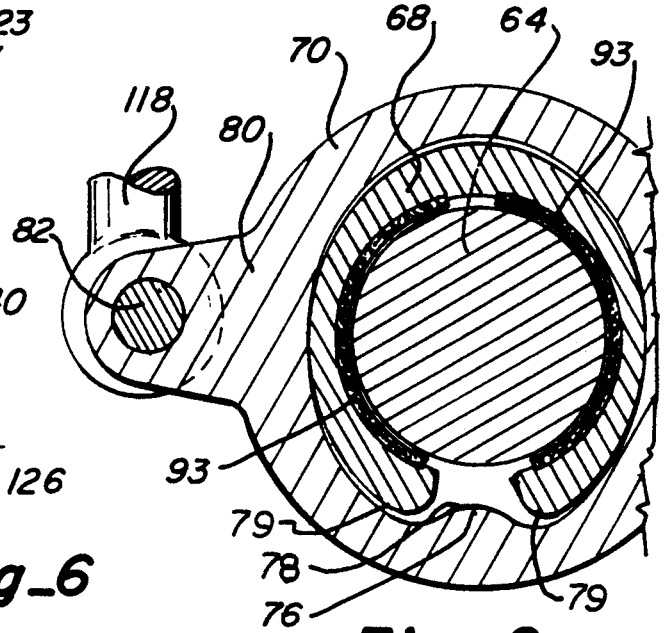
FIG. 9–10 are schematic diagrams illustrating use and operation of the main brake lock apparatus embodiment of this invention.
Figure 10:
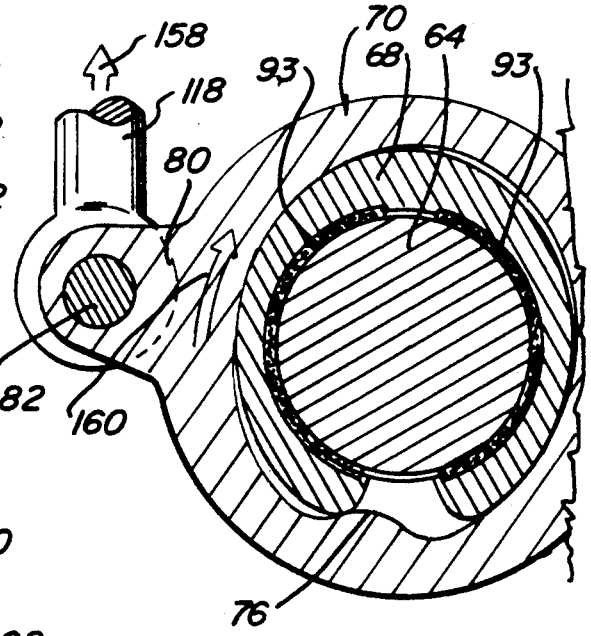

In the use and operation of the main brake lock apparatus 21 embodiment as noted in FIGS. 3, 9, and 10, the brake actuator assembly 62 is interconnected by the connector assembly 94 to the piston and cylinder actuator assembly 96 which, in turn, is connected to the main brake lock assembly 60 for movement of the piston member 110 as noted by an arrow 158 in FIG. 3.

The piston and cylinder actuator assembly 96 is operable in a conventional manner in order to selectively pivot and rotate the outer brake housing member 66 as noted by an arrow 160 in FIG. 3.

Due to contact between the outer contact surface 90 of the elliptical opening 88 in the brake insert member 68 and the inner brake cam surface 74 of the outer brake housing member 66, this causes a decrease in the size of the elliptical opening 88 to cause contact with the shaft 64 to achieve a braking or clutching operation.

It is noted that the brake insert stabilizer 76 with its brake cam surface 78 provides for initial contact with cam contact surfaces 79 and movement of the brake insert member 68 to an elliptical clamping operation as noted in FIG. 10.

As noted in FIGS. 9 and 10, an inner surface of the brake insert member 68 may be provided with the brake lining member 93 to provide a satisfactory wear surface which may be removed and replaced similar to brake lining used in a vehicle.

Figure 5:
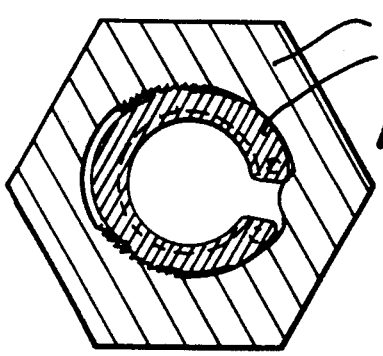
FIG. 5 is a sectional view of the bolt and elliptical lock nut apparatus embodiment.

As noted in FIG. 4, the bolt and elliptical lock nut apparatus 23 comprises two main elements being the inner lock cam insert member 126 mounted within the outer nut housing member 132. This is achieved by placing an insert tool, having prongs thereon, through the tool connector opening 148 and mounting the same therein as noted in the neutral position of FIG. 5. The lock cam insert member 126 can be of various sizes in regard to the central threaded bolt opening 146 so as to be interchangable with a single outer nut housing member 132.

Figure 6:
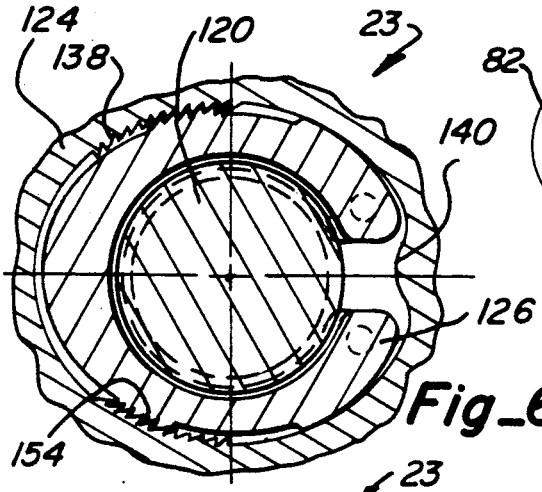
FIGS. 6–8 are fragmentary sectional views illustrating use and operation of the bolt and elliptical lock nut apparatus embodiment of this invention.

In this assembled condition, it is noted that the lock serrated ridges 154, numbering six thereof, are placed in the neutral position to one side of the serrated lock ridges 138 as noted in FIG. 6. This is a neutral position whereupon the bolt member 120 may be threadably mounted in a conventional manner in the threaded bolt opening 146 as noted in FIG. 6.

Figure 7:
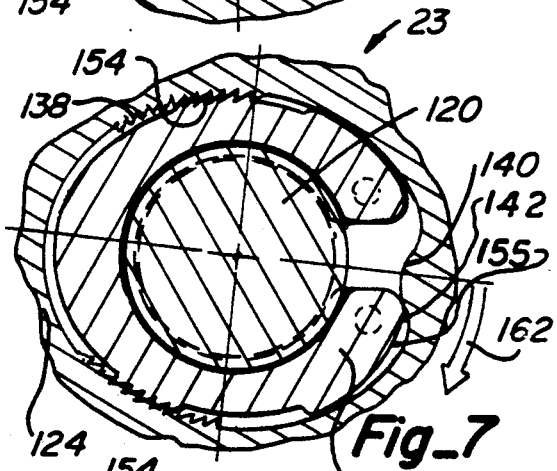

On reaching a point in which the bolt and elliptical lock nut apparatus 23 is to be mounted in a selected longitudinal position on the bolt member 120, it is noted that relative rotation movement of the main lock nut assembly 124 relative to the inner lock insert member 126 is achieved as noted in FIG. 7. As noted by the arrow 162 in FIGS. 7 and 8, movement of the main lock nut assembly 124 relative to the inner lock insert member 126 is shown.

This initial movement causes contact with the nut cam surfaces 142 of the nut stabilizer 140 with outer curved cam contact surface 155 of the inner lock cam insert member 126 as noted in FIG. 7. At the same time, there is a ratchet action due to the inclined nature of the intermeshing teeth of the serrated lock ridges or teeth 138 and the lock serrated ridges or teeth 154 whereupon they are moved relative to each other and are locked so as cannot be moved in an opposite direction.

This intermeshing of the ridges 138, 154 then causes a clamping action of the central threaded bolt opening 146 about the threaded body section 128 of the bolt member 120 due to the engaging elliptical surfaces of the elliptical cavity opening 136 and the outer cam surface 152.

Figure 8:
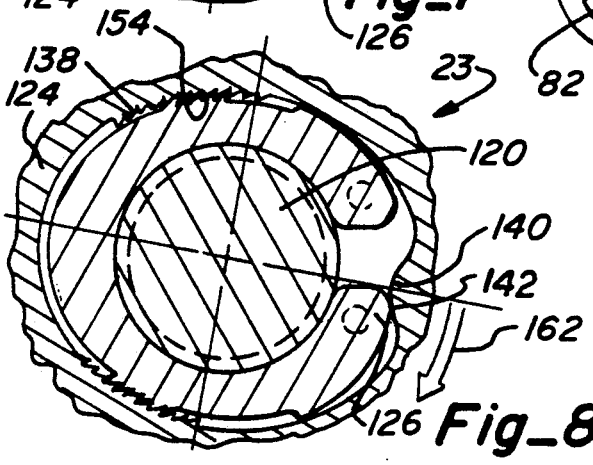

Further relative rotational movement, if possible and necessary, is shown in FIG. 8 whereupon further rotation is noted by arrow 162 which moves the serrated lock ridges 138 to a most compressed locking feature with the lock serrated ridges 154. Of course, this final movement may not be required, necessary, or even accomplished depending on the clamping action of the threaded bolt opening 146 on the threaded body section 128 of the threaded bolt member 120.

It is noted that the bolt and elliptical lock nut apparatus has a new, novel, and unique operation in that it can be operated to achieve a lock nut feature at any longitudinal position along the threaded body section of the bolt member. Further, the use of the ratchet type serrated lock ridges achieves a new and novel one-way ratchet type locking system with the threads of a bolt member.

While the invention has been described in conjunction with preferred specific embodiments thereof, it will be understood this description is intended to illustrate and not to limit the scope of the invention, which is defined by the following claims:

I claim:

1. A cam actuator means with connector assembly operable to contact, grasp, rotate, brake, remove, or insert an object, comprising:

a) a main lock assembly including an outer housing member with a cam insert member mounted therein;

b) said outer housing member formed with an elliptical cavity opening to receive and contact said cam insert member;

c) said elliptical cavity opening having an insert stabilizer with a cam surface to contact a portion of said cam insert member during relative rotational movement therebetween;

d) said cam insert member provided with a cam body having an opening and an outer cam surface; and e) said outer cam surface engagable with said elliptical cavity opening and said insert stabilizer and operable on relative rotation therebetween to change the size of said opening.

2. A cam actuator means with connector assembly as described in claim 1, wherein:

a) said cavity opening and said cam body of cooperating elliptical shapes operable on relative rotation to change the size of said opening.

3. A cam actuator means with connector assembly as described in claim 1, including:

a) a main drive assembly connected to said main lock assembly; and b) said main drive assembly includes a ratchet drive assembly connected to said outer housing member and operable to selectively rotate said outer housing member in opposite directions relative to said cam insert member to cause a change in size of said opening.

4. A cam actuator means with connector assembly as described in claim 1, including:

a) a main drive assembly connected to said main lock assembly;

b) said main drive assembly includes a brake actuator assembly connected to said outer housing member operable to selectively rotate said outer housing member to decrease the size of said opening;

whereby said brake actuator assembly is operable to be used as a brake or a clutch to decrease the size of said opening about a rotating shaft to either connect thereto or brake same against movement.

5. A cam actuator means with connector assembly operable to contact, grasp, rotate, brake, remove, or insert an object, comprising:

a) a main cam lock assembly including a cam insert member mounted within a housing member;

b) said cam insert member includes a central opening to be placed about an object and an outer cam surface;

c) said housing member having an inner cam surface and an insert stabilizer surface engagable with said outer cam surface and operable on relative rotational movement of said inner cam surface and said outer cam surface to change the size of said central opening;

d) said outer cam surface being of an elliptical shape; and e) said inner cam surface being of an elliptical shape contacting and cooperating with said outer cam surface to provide a change in in the size of said opening on relative rotation of said inner cam surface and said outer cam surface to change the size of said central opening.

6. A cam actuator means with connector assembly as described in claim 5, wherein:

a) said cam insert member provided with slot and outer cam surfaces engagable with said insert stabilizer to initially move said cam insert member into a position to decrease the size of said central opening on relative rotational movement therebetween.

7. A cam actuator means with connector assembly as described in claim 5, wherein:

a) said cam insert member having unobstructed areas above and below and line with said central opening to receive the object therethrough for grasping at any longitudinal position thereon.

8. A cam actuator means with connector assembly operable to contact, grasp, and rotate and object for inserting or removing purposes, comprising:

a) a stud extractor and wrench apparatus including a main cam lock assembly connected to a main drive assembly;

b) said main cam lock assembly includes an outer housing member with a cam insert member mounted therein;

c) said outer housing member formed with an elliptical cavity opening to receive and contact said insert member and an insert stabilizer having an outer cam surface;

d) said cam insert member provided with a main cam body having an opening and an outer cam surface; and e) said outer cam surface initially engagable with said insert member and said insert stabilizer to cause movement thereof and said outer cam surface engagable with said elliptical cavity opening and operable on relative rotation therebetween to change the size of said opening.

9. A cam actuator means with connector assembly as described in claim 8, wherein:

a) said outer cam surface on said cam body and said elliptical cavity opening being of cooperating elliptical shapes operable on relative rotation to change the size of said opening to immediately grasp the object therein.

10. A cam actuator means with connector assembly as described in claim 8, wherein:

a) said main drive assembly includes a ratchet drive assembly having a ratchet head assembly connected to said housing member so as to rotate same in either direction to acheive relative movement between said housing member and cam insert member to change the size of said opening.

11. A cam actuator means with connector assembly as described in claim 8, wherein:

a) said cam body provided with a split ring slot; and b) said insert stabilizer positioned between said split ring slot in said cam body and operable on rotation of said housing member to contact cam contact surfaces of said split ring slot in order to achieve an initial inward movement thereof to decrease the size of said opening in order to immediately grasp the object mounted therein.

12. A cam actuator means with connector assembly operable to contact, grasp, rotate, and clutch or brake an object, comprising:

a) a main brake lock apparatus including a main brake lock assembly connected to a brake actuator assembly;

b) said main brake lock assembly includes an outer brake housing member provided with an elliptical brake cavity opening and having a brake insert member mounted therein;

c) said elliptical brake cavity opening is provided with an inner brake cam surface and a brake insert stabilizer having a brake cam surface;

d) said brake insert member having an elliptical brake cam body with a central elliptical opening, an outer cam surface, and a split cam ring slot; and e) said brake cam body having said split cam ring slot mounted about said brake insert stabilizer to initially engage same on relative rotation of said outer brake housing member relative to said brake insert member to provide a decrease in said central elliptical opening to cause grasping of an object therebetween to function either as a brake or a clutch.

13. A cam actuator means with connector assembly as described in claim 12, wherein:

a) a brake actuator assembly includes a connector assembly connected to an object and having a piston and cylinder actuator assembly mounted between said connector assembly and said outer brake housing member; and b) said piston and cylinder actuator assembly operable to selectively rotate said outer brake housing member in either direction to decrease the size of said central elliptical opening to achieve a braking or clutching function.

14. A cam actuator means with connector assembly as described in claim 13, wherein:

a) said piston and cylinder actuator assembly includes a piston and cylinder member connected to fluid control lines to selectively operate same for rotation of said outer brake housing member to achieve a braking function on an object mounted therebetween.

15. A cam actuator means with connector assembly operable to contact, grasp, and lock onto an object, comprising:

a) a bolt and elliptical lock nut apparatus including a main lock nut assembly having an outer housing member with an elliptical cavity opening and a lock cam insert member mounted therein;

b) said elliptical cavity opening provided with a plurality of serrated lock ridges therein;

c) said lock cam insert member includes a nut cam body having a central opening therein provided with an outer cam surface and lock serrated ridges thereon; and d) said serrated lock ridges are engagable with said lock serrated ridges on relative rotation therebetween to achieve a change in the size of said central opening to grasp the object mounted therebetween.

16. A cam actuator means with connector assembly as described in claim 15, wherein:

a) said lock cam insert member is provided with a split ring slot;

b) said outer nut housing member is provided with a nut stabilizer with a nut cam surface thereon; and c) said nut stabilizer positioned between the openings of said split ring slot and engagable on relative rotation therebetween to achieve a change in the size of said central opening to achieve a grasping action on the object mounted therein.

17. A cam actuator means with connector assembly as described in claim 15, wherein:

a) said central opening is a threaded opening operable to be threadably mounted on external threads on the object; and b) said nut housing member operable on rotation relative to said lock cam insert member to provide a decrease in the size of said central threaded opening so as to provide a clamping action on the external threads of the object to achieve a lock nut function;

whereby the lock nut function can be achieved at any desired longitudinal position on the external threads of the object.

18. A cam actuator means with connector assembly as described in claim 15, wherein:

a) said serrated lock ridges and said lock serrated ridges being inclined in the same directions and operable to achieve a one-way ratchet locking function;

whereby relative rotation is achieved in a limited manner due to the contacting of elliptical surfaces and rotation is prevented in the opposite direction due to a one-way ratchet type function of said lock serrated ridges and said serrated lock ridges.

19. A cam actuator means with connector assembly as described in claim 15, wherein:

a) said serrated lock ridges on said outer nut housing of a substantially greater number than said lock serrated ridges on said inner lock cam insert member to permit relative rotation therebetween and provide for a ratchet locking function of this invention on relative rotation therebetween.

* * * * *